United States Patent [19]

den Hartog et al.

[11] Patent Number: 5,009,396

[45] Date of Patent: Apr. 23, 1991

[54] METHOD AND APPARATUS FOR THE MANUFACTURE OF FORMABLE STEEL STRIP

[75] Inventors: Huibert den Hartog, Noordwijkerhout; Erik B. van Perlstein, Beverwijk, both of Netherlands

[73] Assignee: Hoogovens Groep B.V., Ijmuiden, Netherlands

[21] Appl. No.: 414,024

[22] Filed: Sep. 28, 1989

Related U.S. Application Data

[62] Division of Ser. No. 235,152, Aug. 23, 1988.

[30] Foreign Application Priority Data

Sep. 1, 1987 [NL] Netherlands ..... 8702050

[51] Int. Cl.[5] ..... C21D 1/64

[52] U.S. Cl. ..... 266/115; 266/103; 266/108; 266/109; 266/110; 266/111; 266/112; 266/113

[58] Field of Search ..... 266/103, 108–113, 266/115

[56] References Cited

U.S. PATENT DOCUMENTS 4,330,112 5/1982 Toshimitsu et al. ..... 266/115

*Primary Examiner*—R. Dean
*Assistant Examiner*—David W. Schumaker
*Attorney, Agent, or Firm*—Stevens, Davis, Miller & Mosher

[57] ABSTRACT

In the manufacture of formable steel strip having a thickness between 0.5 and 1.5 mm, the following process steps are performed sequentially in a continuous process:

(a) in a continuous casting machine forming liquid steel into a hot slab having a thickness of less than 100 mm, (b) hot rolling the hot slab from step (a), in the austenitic region and below 1100° C., to form strip having a thickness of between 2 and 5 mm, (c) cooling the strip from step (b) to a temperature between 300° C. and the temperature $T_t$ at which 75% of the steel is converted to ferrite, (d) rolling the cooled strip from step (c) at said temperature between 300° C. and $T_t$ with a thickness reduction of at least 25% at a rolling speed not more than 1000 m/min., (e) coiling the rolled strip from step (d).

3 Claims, 2 Drawing Sheets

METHOD AND APPARATUS FOR THE MANUFACTURE OF FORMABLE STEEL STRIP

This is a division of application Ser. No. 235,152 filed Aug. 23, 1988.

BACKGROUND OF THE INVENTION

1. Field of the Invention

The invention relates to a method for the manufacture of formable steel strip with a thickness of between 0.5 and 1.5 mm. Wide strip may be called steel sheet, but in this specification, the term "strip" only is used for convenience. One example of this strip is a product which is suitable for making the external parts of automobile structures. The invention also relates to apparatus for carrying out this method.

2. Description of the Prior Art

In the production of thin steel strip, conventionally the starting material is thick steel slab, having a thickness of between 150 and 300 mm, which after being heated and homogenized at a temperature 1000° C. and 1250° C. is roughened down to form an intermediate slab with a thickness of approximately 35 mm, which is then reduced to a thickness of between 2.5 and 4 mm in a hot strip finishing train consisting of several mill stands. Further reduction to strip with a thickness of between 0.75and 2 mm then takes place in a cold rolling installation. The previously pickled strip is cold reduced in a number of interlinked mill stands, with addition of a cooling lubricant. Methods have also been suggested in which thin slabs are cast, and after being heated and homogenized, are passed direct to a hot strip finishing train.

All such known and proposed rolling processes have been developed for discontinuous rolling operations. The casting of the slabs, the hot rolling of the slabs and the cold rolling of strip take place in different installations, which are effectively used only during a part of the available machine time. In a discontinuous rolling operation, it is necessary for the running of the installations to take into account the entry and exit of each slab and the temperature differences which can occur between the head and tail of each slab. This can lead to complicated and expensive measures.

In the casting of slabs with a thickness of approximately 250 mm, the casting machine must be dimensioned to cope with the weight of the large amount of steel present in the machine. However, a casting machine which casts thinner slabs can be constructed to be more than proportionally lighter and therefore also cheaper.

EP-A-0194118 describes a method in which a steel strip with good properties can be produced by rolling it at a temperature of between 300° C. and 800° C. in a conventional 6-stand hot strip finishing train. Because this rolling process takes place in a two-phase region in which austenitic and ferritic material occur alongside each other, it appears that acceptable r-values (see below) are only achievable if the rolling is carried out with a very high speed of deformation. This speed of deformation, expressed as relative elongation per second, must then be at least 300 per second. As a consequence of this it is not practical to couple the rolling and the casting processes to each other.

EP-A-226446 discloses a method of producing thin steel sheets wherein, in one embodiment, after a hot rolling at 1100° to 700° C. of a continuously cast slab 50 mm or less thick, there is performed a lubrication rolling at a temperature between $Ar_3$ transformation point and 300° C. and at a very high rolling speed of not less than 1500 m/min. Rolling speed as high as 5000 m/min is mentioned. A self-annealing step at 600°–750° C. follows. This lubrication rolling is performed on sheet 2–6 mm thick. It is suggested that this high speed lubrication rolling introduces rolling strain uniformly and effectively to the central portion fo the sheet, resulting in improved microstructure. After the high speed rolling, recrystallisation by strain-annealing proceeds at once. Thus reliance is place on a combination of high-speed rolling and self-annealing.

However, such very high rolling speeds create great problems in a process which is truly continuous from continuous casting to coiling. Rolling mills and coiler for such high speeds are expensive, if available, an a continuous casting machine of the capacity required for such a rolling speed is not available.

SUMMARY OF THE INVENTION

The object of the present invention is to provide a method in which in a single combination of successive process stages liquid steel can be formed into an end product, while the abovementioned difficulties are avoided.

In contrast to the disclosure of EP-A-226466, the present inventors have realised that good results can be obtained when, after hot rolling of continuously cast steel slab in the austenitic region to form sheet, a further rolling of the thin sheet (2–5 mm) can take place at lower speeds (i.e. less than 1000 m/min, preferably less than 750 m/min), provided that this rolling is in the ferritic region, i.e. below temperature $T_f$ (see below). This rolling is preferably followed by overaging at 300°–450° C. The result is a formable thin sheet strip which has good mechanical and surface properties and does not require cold-rolling. Furthermore, the properties of the strip can be selected by varying the ferritic rolling temperature.

In the invention, the rolling speed is well matched to the capacity of presently available continuous casting machines, permitting high productivity with apparatus having relatively low investment cost.

According to the invention in one aspect, there is provided a method for the manufacture of formable steel strip having a thickness between 0.5 and 1.5 mm characterised by the following process steps which are performed sequentially in a continuous process:

(a) in a continuous casting machine, forming liquid steel into a hot slab having a thickness of less than 100 mm, (b) hot rolling the hot slab from step (a), in the austenitic region and below 1100° C., to form strip having a thickness of between 2 and 5 mm, (c) cooling the strip from step (b) to a temperature between 300° C. and the temperature $T_f$ at which 75% of the steel is converted to ferrite, (d) rolling the cooled strip from step (c) at said temperature between 300° C. and $T_f$ with a thickness reduction of at least 25%, preferably at least 30%, at a rolling speed not more than 1000 m/min., and (e) coiling the rolled strip from step (d).

The temperature $T_f$ in ° C. at which on cooling 75% of the austenite is converted into ferrite has a known relationship with the percentage of carbon in the steel, namely $T_f = 910 - 890.(\% C)$.

Because all the process stages follow one another in a truly continuous process, production can be continuous as long as the continuous casting last. During this entire period the material moves throughout the steel-making plant under fixed conditions at any point, so that the entire installations can be controlled by a single homogeneous management system. All elements of the installation are continuously in operation so that optimum availability is achieved. Even at a lower production speed per element than that which is regarded as technically possible in the steel industry, a very acceptable speed of production is achieved.

Of great importance, furthermore, is the fact that thin slabs are cast, so that the casting machine in particular can be made many times lighter and cheaper than is possible with slab casting machines for slab thickness of about 250 mm.

Method of the invention deliberately separates rolling in the austenitic region (step (b)) from rolling in the ferritic region (step (d)) by means of an intermediate cooling (step (c)), so that so-called two-phase rolling is avoided. In this way it is possible to achieve good mechanical and surface properties indenpendently of the speed of deformation. The speed of deformation can thus be adjusted to the available casting speed, and rolling and casting operations can be coupled to form a single process without difficulty.

The invention therefore provides practical possibilities for producing formable steel strip with a final thickness of between 0.5 and 1.5 mm. from liquid steel in a ccontinuous process. Such a continuous process can lead to considerable savings in production costs due to ease of control of the process parameters and further because the material output can be raised to virtually 100%. This will be clear when it is remembered that existing discontinuous processes start from steel slabs which can have a maximum weight of approximately 25 tons. In the method according to the invention the continuous casting of 120 tons of steel is achievable, this entire quantity of steel being processed to form steel strip without interruption.

Austenitic rolling (step (b)) must take place below 1100° C. in order to avoid excessive wear on the rolls. The rolling of the ferritic material (step d)) must take place at a temperature above 300° C. in order that the profile of the strip can be properly controlled.

It has appeared that for good deformability of the steel strip it is preferable to create a certain degree of carbon precipitation in the steel. This process is called "overaging". This can be effected by holding the finished steel strip for a certain length of time at a temperature of between 300° C. and 450° C.. A simple method of doing this consist in coiling the strip at such a temperature and letting it cool down gradually.

As mentioned, the quality of the steel strip produced can be varied by selection of the temperature of ferritic rolling (step (d)). This arises from the possibility of controlling the so-called r value (lankford value) which is dependent on the ratio {111}/{100}, i.e. the relative amounts of the 111 and 100 crystal orientations. ({111} is the volume of the "cube" crystal orientation). For so-called "drawing" quality of steel strip, and r-value close to 1 (e.g. 1.2–1.4) is sufficient. For a good "deep-drawing" quality, the r-value should approach 2(e.g. 1.5–1.8). To achieve a high r-value, it is necessary to obtain a high driving force for recrystallisation following the ferritic rolling, because a high driving force for crystallisation causes the rapid formation of much 111 crystal orientation before the formation of the 100 orientation takes place. The driving force for recrystallisation is proportional to the amount of deformation (dislocations) in the steel.

To this end, in the present invention, a thickness reduction of at least 25% is performed in teh ferritic rolling. If the temperature of the ferritic rolling is high (but below $T_f$), the amount of disclocations is reduced by the phenomenon known as "recovery"(not by recrystallisation). Thus the driving force for recrystallisation is lower, and lower r-values will be achieved. When a low r-value is acceptable, e.g. in "drawing" quality steel strip, the present invention can provide a simple process, preferably the ferritic rolling takes place in the range 650° C. to $T_f$, and no reheating for recrystallisation is required. Overaging may take place, as discussed.

Alternatively, the invention particularly provides a beneficial process for obtaining a steel of "deep-drawing" quality with high r-value. In this case, the ferritic rolling takes place at 400°–600° C. (preferably 400°–500° C. ) and is followed by a recrystallising annealing step at above 620° C. for at least 0.1 seconds, preferably at 700°–850° C. for 5–60 seconds, e.g. at 800° C. for about 30 seconds. The low temperature of ferritic rolling prevents "recovery", so that a high driving force for recrystallisation is retained; then in the recrystallising annealing step, a high r-value is achieved.

Preferably in such a process, the hot rolled strip is cooled to a temperature at which at least 90% of the mateial is converted into ferrite, before the ferritic rolling. For some grades of steel this means cooling to below about 500° C.

Useful processes can be achieved in the steel if the overaging step is decoupled from the coiling of the strip. In this case the strip may be overaged before coiling, e.g. at 400° C. for about 60 seconds, and is then cooled to below 80° C. before being coiled. Before coiling the strip, it can be subjected for example to pickling treatment and/or to a temper rolling with a reduction of between 0.2 and 10%. In this way, it is possible to achieve great variation in the external appearance of the strip surface and in the ultimately desired surface hardness, and the shape of the strip can also be corrected.

Preferably the slab is cast with a thickness of approximately 50 mm.

It is desirable for the hot rolling (step (b)) to choose a process which can bring about a considerable reduction in thickness in a few stages and at relatively low speed. Preferable here is a method in which a main reduction takes place in a planetary mill stand, after which a rolling reduction of not more than 40%, e.g. 10 to 20% is applied, preferably by a planishing mill stand, in order to correct the shape of the strip and improve the crystal structure. The main reduction by the planetary mill stand can lead to a very fine grain size which is undesirable for deep-drawing qualities. The second-stage small reduction of not more than 40% at the prevailing rolling temperature can then lead to a critical grain growth which converts the fine grains into more desirable coarse grains. A planetary mill stand can give rise to the formation of a light wavy pattern in the sheet. By the further reduction in the planishing mill stand it has appeared possible to remove this wave shape entirely. Optimum rolling conditions can be achieved in the planetary mill stand if before hot rolling the slab is first passed through a homogenising furnace which is held at a temperature of 850° C. -1100° C., preferably about 950° C.

Depending on the intended use of the sheet material, higher or lower demands are made on the surface quality. These will also be dependent on the type of steel which is being processed. In many cases, however, it is preferable to remove an oxide skin from the material surface after at least one of the casting of the slab and the austenitic rolling. Methods of doing this are known in hot rolling technology.

The invention also relates to apparatus which can be used for carrying out the method described above. This apparatus has the following items arranged in the sequence below so as to perform a continuous process:

(i) at least one continuous casting machine for forming liquid steel into slabs having a thickness of 30 to 100 mm, (ii) a homogenizing furnace for the slab from (i), (iii) a planetary mill followed by a planishing mill stand for hot rolling of the slab from (ii) into strip, (iv) means for cooling the strip from (iii) to a temperature in the range 300 to 850° C. and homogenizing the strip at that temperature, (v) at least one four-high mill stand for rolling the strip from (iv), (vi) a furnace for recrystallization-annealing of the strip from (v) at a temperature of at least 620° C., (vii) cooling means for cooling the strip from (vi), and (viii) at least one strip coiler.

Preferably, this apparatus further has:

(vii-a) a homogenization furnace for homogenizing the strip from (vii) for overaging at a temperature in the range 300° C. to 450° C.

The apparatus may further have, after (vii) and after (vii-a) if provided (vii-b) before (ix), cooling means for cooling the steip to below 80° C., (vii-c) between (vii-b) and (ix), pickling means for pickling the strip from (vii-b)

(vii-d) between (vii-c) and (ix), a four-high temper mill stand for the strip from (vii-c).

BRIEF INTRODUCTION OF THE DRAWINGS

The invention will now be illustrated by description of three embodiments, which are not limitative and are described with reference to the accompanying drawings, in which.

DESCRIPTION OF THE PREFERRED EMBODIMENTS

Figure 1:
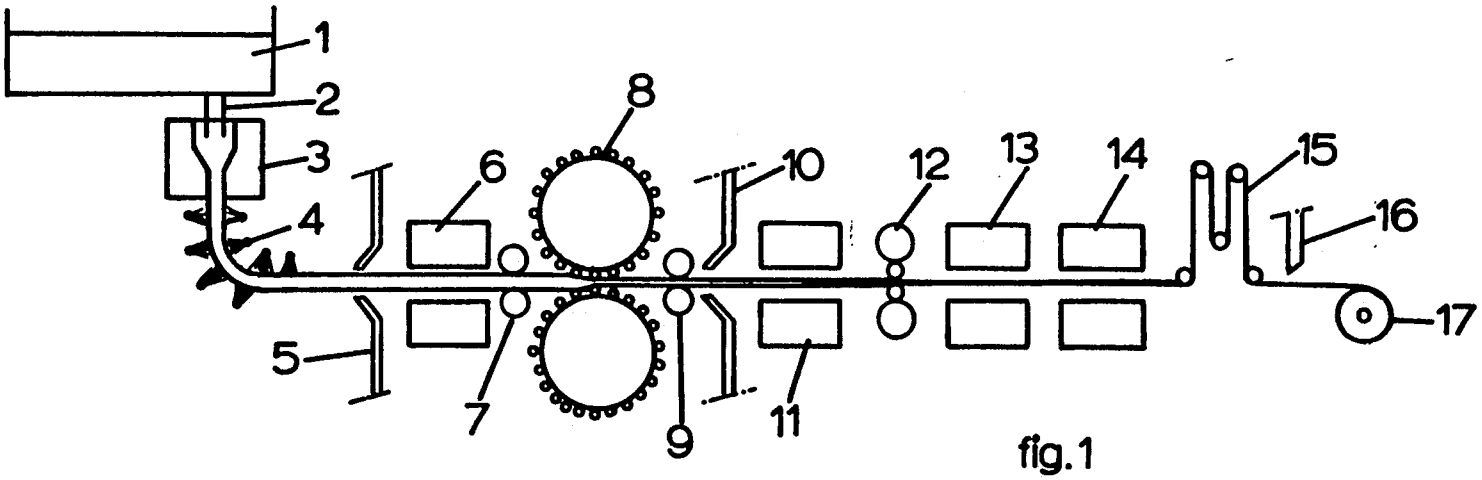
FIG. 1 shows diagrammatically a first apparatus according to the invention, for carrying out an embodiment of the method of the invention.

FIG. 1 shows the tundish of a casting machine for steel, from which a nozzle 2 extends into a cooled mould 3. The partially solidified slab leaves the mould and is further cooled by liquid sprayers 4. At this stage the slab is turned into a horizontal direction. High pressure nozzles 5 blow the oxide film formed from the slab surface before this slab is passed through a furnace 6 in which the slab temperature is homogenized at approximately 950° C. From the furnace 6 the slab is then drawn through feed rollers 7 and rolled in a planetary mill stand 8.

In a typical production process of the invention, a slab with a thickness of about 50 mm and width of about 1250 mm is cast at a speed of about 5 m per minute. The planetary mill stand is of a type known in rolling technology and described in the literature, in which in one pass the thickness of the slab can be reduced to between 2 and 5 mm. This reduction produces a very fine-grained austenitic material which is then passed through a planishing mill stand 9. Here the material thickness is reduced once more by a maximum of 40%, which at the prevailing temperature of the material can lead to a critical grain growth. By correctly adjusting the reduction through the mill stand 9, the temperature and the composition of the steel, it is possible in this rolling stage to convert the fine grain structure into a coarse grain structure. This coarse structure is preferable especially if the finished rolled material is intended for deep-drawing.

The temperature of the furnace 6 can be adapted to the steel quality and the desired material properties. The condition must however be stipulated that after passing through the mill stand 9 the material must be entirely austenitic. Care must also be taken to ensure that the temperature is not too high, because above 1100° C. excess wear on the rolls can occur.

After the rolled material leaving the mill stand 9 is again freed of oxide skin by means of the oxide breaker 10, rapid cooling takes place in a cooling installation 11. In this installation 11 the cooled material is further homogenised at a lower temperature level, the temperature of which can be freely chosen between 300° C. and $T_t$, preferably between 400° C. and 800° C. If the ultimate material should be of so-called "drawing" quality, then this temperature may be approximately 700° C., if "deep drawing" quality is sought, however, it must be further cooled below 600° C., preferably below 500° C. In any case, the cooling must be carried out to such an extent that at least 75% and preferably more than 90% of the austenite crystals are converted into ferrite crystals. Further cooling is possible, but it has appeared that the controllability of the strip profile is less with cooling below 300° C.

After being cooled the material is rolled in the ferritic phase in a four-high mill stand 12 to a thickness which can vary between for example 0.6 and 1.5 mm, again dependent on the ultimate material thickness desired. The thicknesses of the material before and after the four-high mill stand must be adjusted to each other in such a way that in any case a reduction of at least 25% is achieved in the four-high mill stand 12, though preferably a reduction of more than 40%, e.g. 60% should be sought.

If the ferritic rolling has taken place at a temperature below the recrystallisation temperature, the material, hardened by the ferritic rolling, is then recrystallisation annealed by passing it through a furnce 13. Then further cooling takes place to approximately 400° C. in the cooling installation 14.

The recrystallisation annealing in furnace 13 is not required or is optional if the rolled material is passed through the four-high mill stand 12 at a temperature approaching 700° C. For better deep-drawing grades of steel it is however preferable to carry out the ferritic rolling below 500° C. and then to recystallise the material by annealing in order to achieve the desired mechanical properties.

In the method of the invention, a relatively low process speed is employed, which makes it possible that following the last rolling reduction sufficient heat can be supplied to the strip in order to cause the steel to recrystallise. For complete recrystallisation the steel must be held for at least 0.1 second at at least 620° C., although for top qualities preference is given to recrystallisation at 800° C. for 30 seconds in a non-oxidising atmosphere.

The finished material can be coiled on the coiler 17, for which purpose the strip is cropped periodically by the shears 16. A looping tower or looping pit 15 makes it possible to couple the continuous process to the discontinuous reeling on one or more coilers 17.

In order to guarantee good surface quality, the formation of an oxide skin must be restricted and the steel strip should preferably be coiled at a temperature below 450° C. In addition, it is also preferable for optimum deformability to create a certain degree of carbon precipitation in the steel at a temperature of at least 300° C., (overaging). Thererfore, in the method described in FIG. 1, the steel is coiled at a temperature of between 300° and 450° C.

Figure 2:
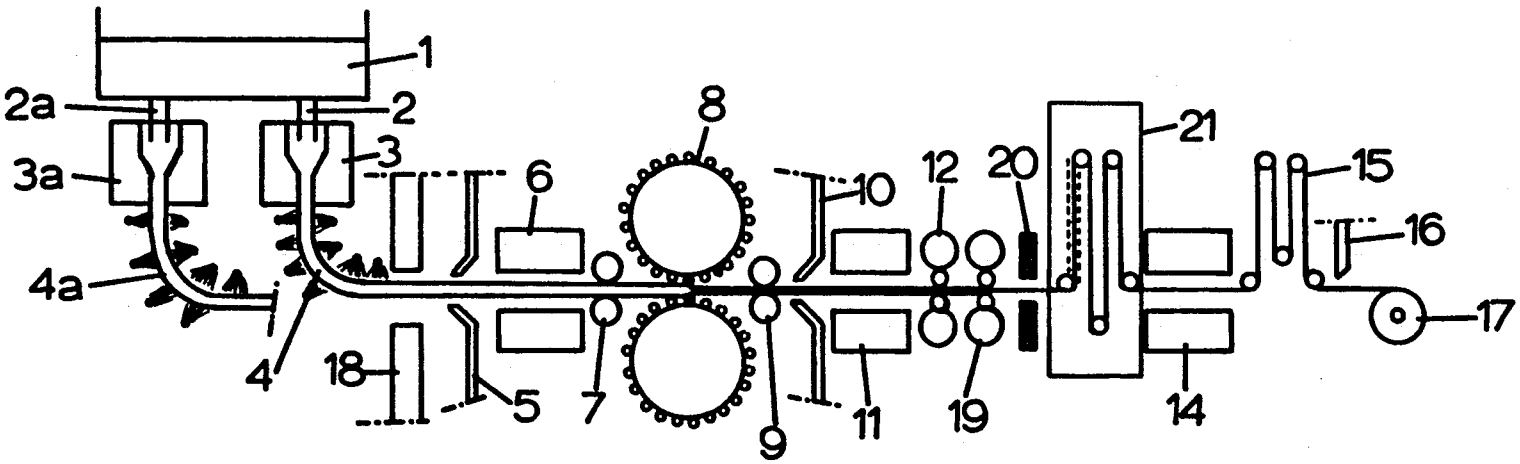
FIG. 2 shows a modified version of the apparatus of FIG. 1.

FIG. 2 shows a variant of the method according to FIG. 1, in which corresponding elements are indicated by corresponding reference figures.

Coupled to the same tundish 1 there are arranged two immersion nozzles 2 and 2*a* and two cooled moulds 3 and 3*a*, with spray sections 4 and 4*a* respectively. By giving different dimensions to the moulds 3 and 3*a* in terms of slab thickness and slab width, it is possible to process in the same apparatus slabs of different dimensions. With the help of a bonding installation 18, shown diagrammatically, it is possible to attach the end of the slab emerging from mould 3 to the head of the slab emerging from mould 3*a*, so that uninterrupted processing is possible. If however the speed of the two slabs is not the same, it is preferable not to join the two slab ends together, but to create a welded joint in the strip with the help of the welding machine 20. Depending on the method of working with the installation it may appear necessary to install a looping tower or looping pit (not shown) in front of the welding machine 20.

In FIG. 2 two four-high mill stands 12 and 19 are shown, in which it is possible to bring about a greater ferritic reduction if this is desired for the quality of the ultimate material. This will mostly be the case for high quality "deep drawing" grades, which will then required recrystallisation annealing. For this purpose, instead of the continuous furnace 13 of FIG. 1, a furnance 21 is provided in which the material can have a longer dwell time of between 10 and 90 seconds. For average material thickness the speed of the strip here will be approximately 300 m per minute, which means that the furnace 21 must have a length of between 50 and 450 m. The non-oxidising atmosphere in this furnace must be capable of being regulated to 800° C.

Figure 3:
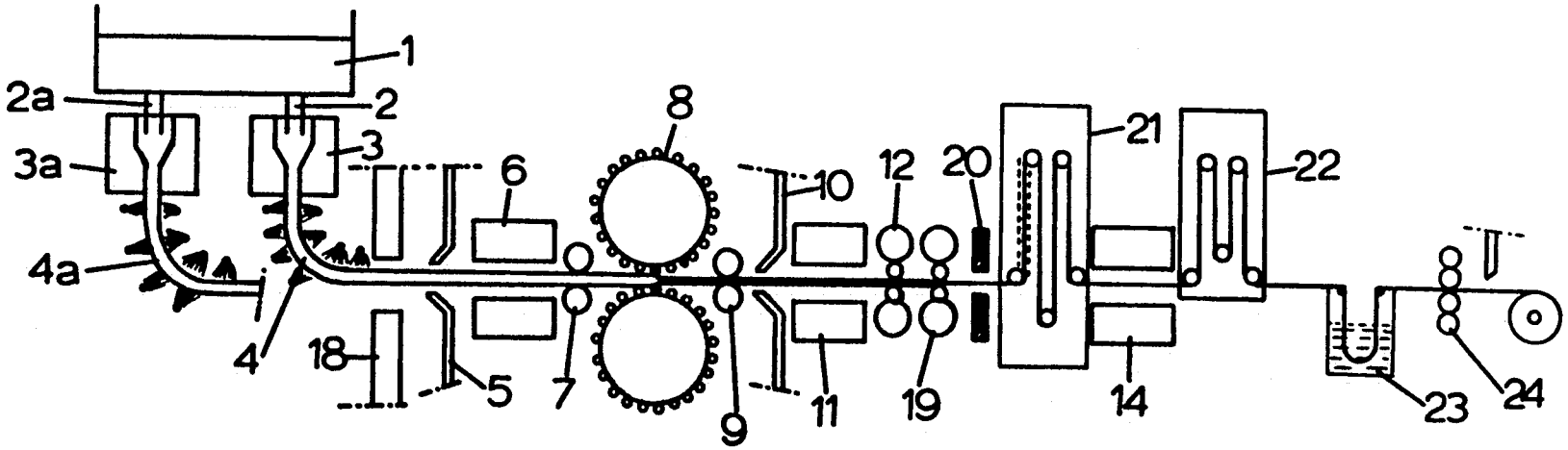
FIG. 3 shows a further modified version of the apparatus of FIG. 1

FIG. 3 shows a further variant, in which all elements in the direction of movement of the material after the cooling installation 14 are modified with respect to the embodiment of FIG. 2. The looping tower 22 in this case is made in the form of a closed furnace in order to bring about overaging by carbon precipitation in the steel before coiling on the coiler 17. The furnace 22 serves for overaging of the material for approximately 60 seconds at a temperature of approximately 400° C. In the end section of the furnace 22, cooling is provided whereby the material is cooled to below 80° C. As a result it is possible to give the material which leaves furnace 22 further improvement treatment. For example, the material can be passed through a pickling installation 23 in which it can be pickled for example with hydrochloric acid in order to reduce the thickness of the oxide skin, or even to remove this oxide skin completely. Then the pickled strip can be passed through a temper mill 24 in which a further reduction of between 1 and 10% can be given at below 80° C. By adjusting this reduction it is possible, in combination with the setting of the furnace 21 for recrystallising annealing and of the furnace 22 for overaging, to achieve a very broad selection of product properties. With the appartus described, a choice can be made using the method described between manufacturing a drawing quality with an r-value of between 1.2 and 1.4, a deep drawing quality with an r-value of between 1.5 and 1.8; two-phase high strength steels; fully hardened strip suitable for further processing in a hot dip galvanising bath installation; so-called tin plating qualities, silicon steel for electro-magnetic applications with a low deformation resistance at 700° C; material with a thin, good-adhering and deformable oxide skin as a cheap corrosion protection; plate material with extra cleam surface, for example for the manufacture of tanks and radiators, and also corrosion resistant steel strip and many other quality variants.

Important in the method according to the invention is the very high availability and flexibility of the apparatus, so that a wide variety of products can be manufactured without intermediate storage. Between the liquid steel phase and the temper rolled end product the time span in the process line is less than one hour. Although the complete installation is simple and requires relatively low investment, due to its very high availability capacities of up to one million tons are achievable annually.

Finally, the method of the invention makes possible very simple and effective controllability of essential process quantities such as the form and smoothness of the strip and of the various temperatures via feedback control methods.

What is claimed is:

1. Apparatus for the manufacture of formable steel strip having a thickness between 0.5 and 1.5 mm , having the following items arranged in sequence:

(i) at least one continuous casting machine for forming liquid steel into slabs having a thickness of 30 to 100 mm, (ii) a homogenizing furnace for the slab from (i), (iii) a planetary mill followed by a planishing mill stand for hot rolling of the slab from (ii) into strip, (iv) means for cooling the strip from (iii) to a temperature in the range 300° to 850° C. and homogenizing the strip at that temperature, (v) at least one four-high mill stand for rolling the strip from (iv), (vi) a furnace for recrystallization-annealing of the strip from (v) at a temperature of at least 620° C., (vii) cooling means for cooling the strip from (vi), and (viii) at least one strip coiler.

2. Apparatus according to claim 1, further having:

(vii-a) a homogenization furnace for homogenizing the strip from (vii) for overaging at a temperature in the range 300° to 450° C.

3. Apparatus according to claim 1 further having, after (vii)

(vii-b) if (vii-a) is provided before (viii) and after (vii-a), coooling means for cooling the strip to below 80° C., (vii-c) between (vii), or if provided (vii-b), and (viii), pickling means for pickling the strip from (vii) or if provided (vii-b), (vii-d) between (vii-c) and (viii), a four-high temper mill stand for the strip from (vii-c).

* * * * *